US005729913A

United States Patent [19]

Rucker

[11] Patent Number: 5,729,913

[45] Date of Patent: Mar. 24, 1998

[54] DRYER FOR PAPER MACHINE

[75] Inventor: Kevin Scott Rucker, Pasco, Wash.

[73] Assignee: Boise Cascade Corporation, Boise, Id.

[21] Appl. No.: 701,249

[22] Filed: Aug. 21, 1996

[51] Int. Cl.[6] ..... D21F 5/00

[52] U.S. Cl. ..... 34/456; 34/117

[58] Field of Search ..... 34/451, 452, 453, 34/455, 456, 459, 460, 114, 115, 116, 117, 120, 126

[56] References Cited

U.S. PATENT DOCUMENTS

| | | | |
|---|---|---|---|
| 3,263,344 | 8/1966 | Stickle | 34/116 |
| 3,608,340 | 9/1971 | Fleissner | 34/115 X |
| 3,751,822 | 8/1973 | Crist | 34/117 |
| 3,868,780 | 3/1975 | Soininen et al. | 34/116 |
| 4,172,007 | 10/1979 | Kankaanpaa | 162/206 |
| 4,183,148 | 1/1980 | Koski et al. | 34/454 |
| 4,359,827 | 11/1982 | Thomas | 34/452 |
| 4,483,083 | 11/1984 | Chance | 34/113 |
| 4,625,430 | 12/1986 | Aula et al. | 34/392 |
| 4,625,434 | 12/1986 | Karlsson et al. | 34/114 |
| 4,665,631 | 5/1987 | Villalobos | 34/114 |
| 4,744,156 | 5/1988 | Futcher | 34/114 |
| 5,062,216 | 11/1991 | Hannigan | 34/453 |
| 5,279,050 | 1/1994 | Törmänen | 34/117 |
| 5,539,999 | 7/1996 | Kuhasalo | 34/455 |

*Primary Examiner*—Henry A. Bennett
*Assistant Examiner*—Steve Gravini
*Attorney, Agent, or Firm*—Klarquist Sparkman Campbell Leigh & Whinston, LLP

[57] ABSTRACT

An improved two-tier, single-felted dryer section has an upper tier of spaced apart dryer drums and a lower tier of spaced apart dryer drums. The section includes at least one dryer drum group consisting of a first and second adjacent drum in one tier, a third drum in the other tier located between the adjacent first and second drums, and two reversing rolls positioned one on each of the opposite sides of the third drum. A felt-supported paper web follows a serpentine path about the dryer drums and reversing rolls. As a result, the felt-supported web passes through the dryer drum group with the web in direct contact with each of the three dryer drums in the dryer drum group.

49 Claims, 3 Drawing Sheets

DRYER FOR PAPER MACHINE

FIELD OF THE INVENTION

The present invention relates to an improved two-tier dryer section for a paper machine.

BACKGROUND OF THE INVENTION

A paper machine has various sections, generally including a section for forming the paper and a section for pressing the paper into a paper web. At the time of formation, the paper web is wet, and therefore paper machines also include a section for drying the paper web.

A dryer section generally includes a series of heated dryer drums. The wet paper web is dried by threading the web over the surfaces of the heated dryer drums.

Generally, the paper web is carried through the dryer drum section by a single felt sheet or multiple felt sheets. Optimally, the web is constantly supported by the felt sheet or sheets to lessen the likelihood of web breakage and to allow the paper web to be fed through the dryer section at the highest possible speed.

The dryer drums in a dryer section are arranged in a variety of configurations. The number of drums required in a particular dryer section depends upon the drying efficiency of the dryer drums in the section. If the drums in a section are inefficient, more drums are required to dry the paper web, and more space is required to accommodate the extra drums. A larger number of drums in a dryer section also increases costs and the time it takes the paper web to complete its path through the section. It is therefore desirable to increase the efficiency of the dryer drums, so that the paper will be dried faster, resulting in increased paper production at lower cost.

Two popular configurations of dryer sections are single-tier and two-tier sections. A single-tier dryer section is one in which the heated drums are arranged in a single-tier as shown in Hannigan, et al., U.S. Pat. No. 5,062,216. Single-tier dryer sections are long and therefore require a large amount of mill area. Therefore, many existing paper machines have two-tier dryer sections, such as those disclosed in Aula, et al., U.S. Pat. No. 4,625,430 and Karlsson, et al., U.S. Pat. No. 4,625,434. The two-tier design has resulted from efforts to preserve mill space (area) by positioning as many dryer drums as possible into a compact area.

A two-tier section generally has an upper tier of spaced apart dryer drums and a lower tier of spaced apart dryer drums. The centers of the upper tier drums are generally offset from the centers of the lower tier drums, and oftentimes the center of each upper tier drum is directly above the midpoint between the centers of adjacent lower tier drums.

Two-tier sections may be of either a uno-run type, also called a single-felted run, or a double-felted type. In a single-felted run, a single felt supports the paper web and wraps both the upper and lower tiers of drums.

A double-felted run includes a top felt supporting the web as it travels in direct contact with the upper tier dryer drums and a bottom felt that supports the web as it travels in direct contact with the bottom tier of drums. In a single-felted, two-tier dryer section, the paper web, together with the felt, follows a serpentine path over the upper surfaces of the upper tier drums and over the lower surfaces of the lower tier drums. The web comes into direct contact with a heated drum surface of only every other drum because of the intervening felt.

For example, in one version of a single-felted dryer section, the web and felt pass through the dryer section in a serpentine fashion, entering the dryer section at a first lower tier drum. On the first lower tier drum, the felt wraps directly around a lower surface of the first lower tier drum, and thus the web does not directly contact the lower tier drum because the felt is sandwiched between the web and the drum surface. The felt and web then proceed to wrap around an upper surface of the first upper tier drum, where the web directly contacts the first upper tier drum surface and is sandwiched between the felt and the drum. The web and felt repeat the aforementioned path through the remainder of the dryer section alternating their direct contact with the drum surfaces. Thus, the web is always in direct contact with the upper surface of each upper tier drum and the felt is always in direct contact with the lower surface of each lower tier drum.

Double-felted, two-tier dryer sections represent an attempt to achieve greater drying efficiency than with a single-felted, two-tier dryer section by having the paper web make direct contact with both the upper and lower tier dryer drums. A double-felted, two-tier dryer section generally has a top felt, a bottom felt, and unheated rollers between the drums in each tier, as shown in Koski, et al., U.S. Pat. No. 4,183,143. The top felt wraps around the upper surfaces of the upper tier drum and the lower surfaces of the unheated rollers in the upper tier, and the bottom felt wraps around the lower surfaces of the lower tier drums and the upper surfaces of the unheated rollers in the lower tier. The paper web travels in a path alternating between the upper and lower tier drums. The web is always in direct contact with both the upper and lower tier drums but is unsupported when traveling between tiers. A two-tier, double-felted section is often referred to as a "double-tier" section.

An advantage of a single-felted section over a double-felted section is that the web is constantly supported by the felt and is therefore less likely to break. A drawback, however, is that there is a loss in drying efficiency because the felt essentially insulates the web sheet from the heat emitted by the lower tier dryer drums, and thus there is virtually no heat transfer from the lower dryer drums to the web sheet, in effect being little, if any, more effective in drying than a single-tier section. In fact, the heat transfer is so minimal that in at least one case, to conserve energy, the user does not heat the tier of dryer drums that contact only the felt. This results in inefficient and slow drying.

Nevertheless, many paper companies have purchased at great capital cost and continue to use paper-making machines with two-tier, single-felted dryer sections. Replacing these dryers with newer, more efficient dryer sections would be prohibitively expensive. Moreover, newer, more efficient dryer sections would likely be incompatible with the remaining components of existing paper-making machines, including the buildings in which they are housed, because of differences in configurations and space requirements between old single-felted, two-tier dryer sections and the newer such sections. It is often also impractical and uneconomical to replace an entire paper-making machine and the building in which it is housed in order to accommodate a new dryer section because of their high replacement cost and their exceptionally long useful life, usually about 50 years. Therefore, paper companies continue to use the two-tier dryer sections even though there is essentially no heat transfer from the lower tier drums to the web. Accordingly, there remains a need for improving the drying efficiency of existing two-tier dryer sections without changing appreciably their existing configurations and space requirements.

Others have used turning rolls in dryer sections in an attempt to combat the inefficiency of having the felt between the heated dryer drum and the wet paper web. Specifically, Soininen et al. U.S. Pat. No. 3,868,780, Futcher, U.S. Pat. No. 4,744,156, and Chance, U.S. Pat. No. 4,483,083 each disclose dryer sections having turning rolls between vertically stacked dryer drums. None of these patents, however, attempted to improve the efficiency of existing two-tier dryer sections, and using the dryer sections disclosed in each of the patents would require scrapping the existing two-tier dryer sections and building new buildings for the new machines, which would require a huge cash outlay.

The primary objective of the present invention is to provide a method and means for improving the drying efficiency and thus the productivity of existing single-felted, two-tier dryer sections of paper machines to prolong their useful life so that they do not have to be replaced with expensive new dryer sections in order to compete in a highly competitive paper market, and in order to avoid having to perhaps replace an entire paper machine at many millions of dollars. A more specific objective is to provide an economical method of modifying current conventional single-felted, two-tier dryer sections to enhance drying efficiency and thereby improve paper productivity.

SUMMARY OF THE INVENTION

The present invention is a two-tier dryer section having improved drying efficiency compared to a standard two-tier dryer section. The invention also includes a method of enhancing the drying efficiency of an existing two-tier dryer section.

In a preferred embodiment, the dryer section has an upper tier of spaced apart dryer drums and a lower tier of spaced apart dryer drums. The upper tier of drums is offset relative to the lower tier so that each upper tier drum is above the space between adjacent lower tier drums. A pair of reversing rolls is positioned one on each of opposite sides of a lower tier dryer drum so that each reversing roll is beneath one of two adjacent upper tier dryer drums. The two adjacent upper tier drums and the lower tier drum form a dryer drum group. The dryer section may comprise multiple such groups. The web and felt are fed through a dryer drum group first over the upper surface of a first upper tier drum, around the lower surface of a first of the reversing rolls, then over the upper surface of the lower tier drum, then around the lower surface of the second of the reversing rolls, and finally over the upper surface of the second upper tier drum. Thus, the web is in direct, face-to-face contact with each dryer drum in the dryer drum group. In other words, the first reversing roll reverses the position of the felt and the web so that the web directly contacts the upper surface of the lower tier drum, instead of the felt directly contacting the lower surface of the lower tier drum as would be the case in a conventional two-tier dryer section.

The direct contact between the web and the lower tier drums improves the rate of heat transfer between the lower tier dryer drums and the paper web, which leads to faster drying of the web and thus improved productivity in paper making. Also, with improved heat transfer, the web dries to "higher solids", meaning that the web is stronger and more resistant to web breaks. Reduced web breaks improve papermaking machine efficiency and thereby productivity.

Another advantage is that increased heat transfer allows the paper machine to operate at a higher speed, which also improves paper machine productivity.

The invention would also be suitable for use in dryer drum groups that have two lower tier drums, one upper tier drum, and two reversing rolls positioned around the upper tier drum.

The foregoing and other objects and advantages of the invention will become more apparent from the following detailed description of a preferred embodiment that proceeds with reference to the accompanying drawings.

DETAILED DESCRIPTION OF A PREFERRED EMBODIMENT

Figure 1:
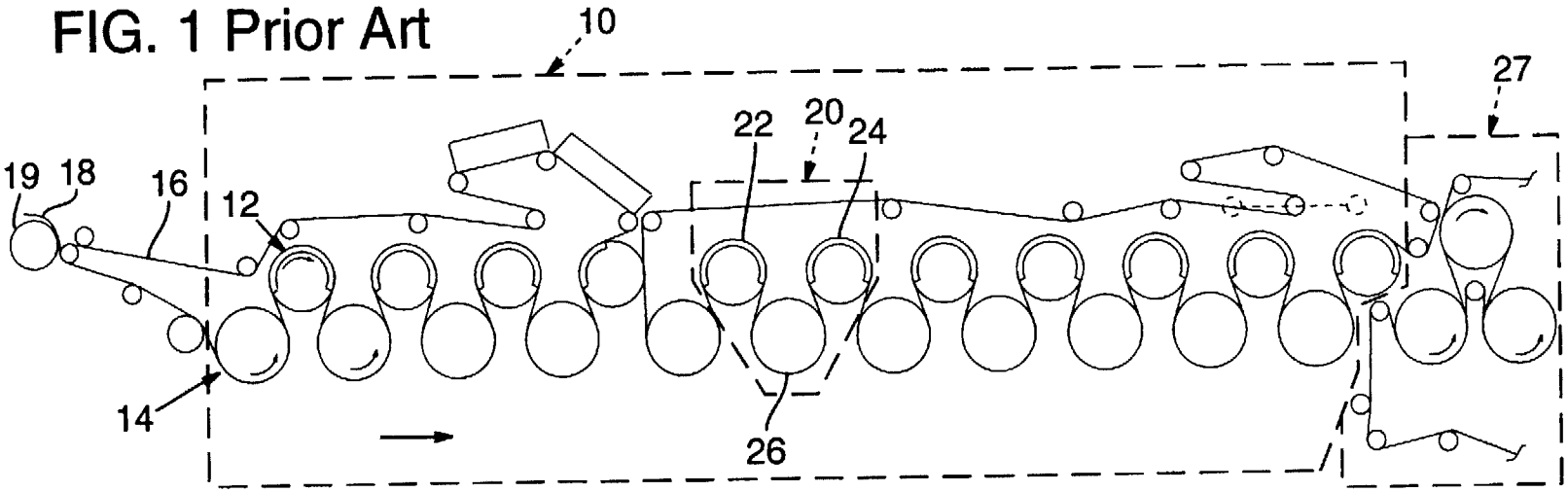
FIG. 1 Prior Art
FIG. 1 is a schematic side elevational view of a prior art two-tier, single-felted dryer section.

Referring to FIG. 1, a two-tier, single-felted dryer section 10 of the prior art is shown. The prior art section 10 has an upper tier 12 of spaced apart dryer drums and a parallel, lower tier 14 of spaced apart dryer drums. The upper tier drums 12 are offset from the lower tier drums 14 so that the center of each upper tier drum 12 is approximately at the midpoint between the center of the two adjacent lower tier drums 14. A paper web 18, supported by a single felt 16, enters the dryer section 10 (from the left) at press roll 19 and follows a serpentine path through the upper and lower tiers of dryer drums 12 and 14, alternating between wrapping over the top of the upper tier drums 12 and around the bottom of the lower tier drums 14, as best seen in FIG. 3.

In the illustrated dryer section, all the upper tier drums 12 rotate clockwise and all the lower tier drums 14 rotate counterclockwise, and the felt 16 and web 18 travel from left to right (as illustrated by the arrow in FIG. 1). However, dryer sections in which the upper tier drums rotate counterclockwise and the lower tier drums rotate clockwise could be constructed.

Figure 3:
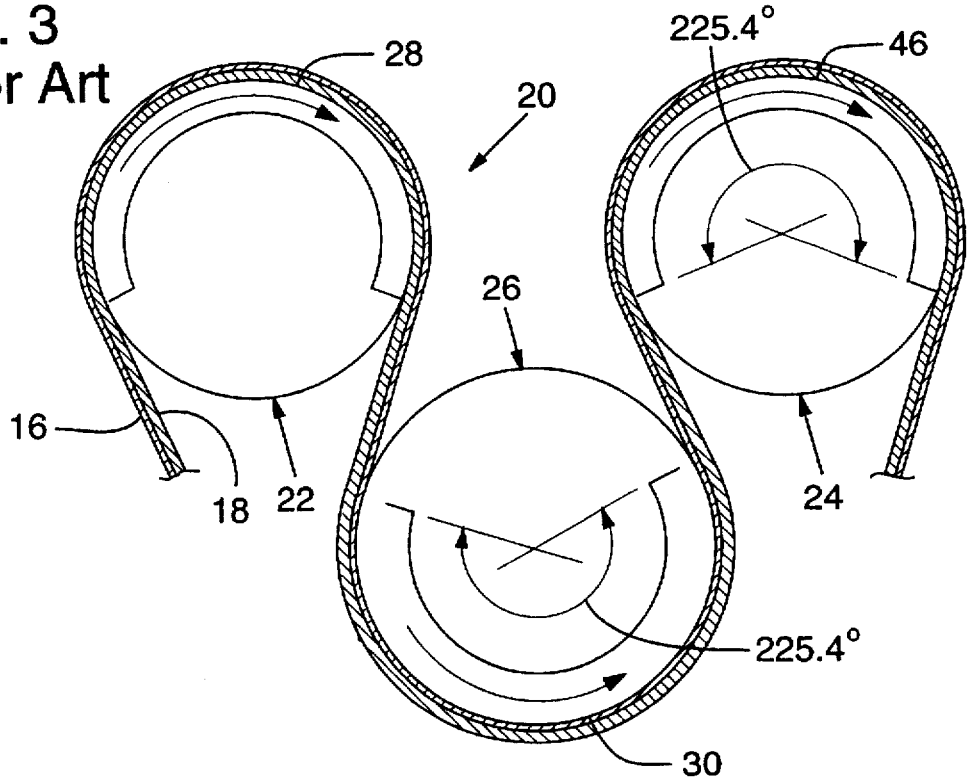
FIG. 3 Prior Art
FIG. 3 is an enlarged, schematic side elevational view of a group of three dryer drums from the dryer section in FIG. 1, showing the passage of the web and felt through the dryer drums.

FIG. 3 shows a group 20 of three dryer drums from the dryer section 10 of FIG. 1. The dryer drum group 20 consists of two adjacent upper tier drums 22, 24 and a lower tier drum 26. The illustrated drums 22, 24 have a 30-inch diameter. However, other diameter drums could be used instead.

The paper web 18 wraps around the upper surface 28 of the first upper tier drum 22 and then wraps around the lower surface 30 of the lower tier drum 26. The web 18 and felt 16 contact 225.4° of both the illustrated upper tier and lower tier drums 22, 24, and 26, both of which have 30-inch diameters. If a drum of different diameter is used, the angle over which the web and felt contact the drums 22, 24 and 26 may change accordingly.

As illustrated, as the felt 16 and web 18 wrap around the upper surface 28 of the upper tier drum 22, the web 18 is in direct, face-to-face contact with the upper tier drum 22. However, when wrapping around the lower tier drum 26, the felt 16 is in direct contact with the lower tier dryer drum 26 and the web 18 is on the outside of the felt 16.

The felt 16 and web 18 proceed through the remainder of the dryer drum section 10 in this manner with the web 18 directly contacting the upper surfaces of the upper tier drums 12 and the felt 16 directly contacting the lower surfaces of the lower tier drums 14.

The web 18 then enters a two-tier, double-felted section 27. The bottom tier of dryers in the double-felted section 27 dries the opposite face from that dried in the single-felted section 10.

The felt 16 has poor heat transfer characteristics, and because the felt 16 is between the web 18 and the lower tier drums 14 in the uno-run section 10, the felt essentially insulates the web 18 from the lower tier drums 14. Thus, essentially no heat is transferred from the lower tier dryer drums 14 to the web 18, and heat is only transferred to the web during the 225.4° wraps that the web 18 and felt 16 make around the upper tier drums 12. Thus, during the wraps around the drums in the dryer drum group 20 illustrated in FIG. 3, heat is only transferred to the web 18 over a total angular amount of 450.8° (225.4°×2 upper tier drums).

Figure 2:
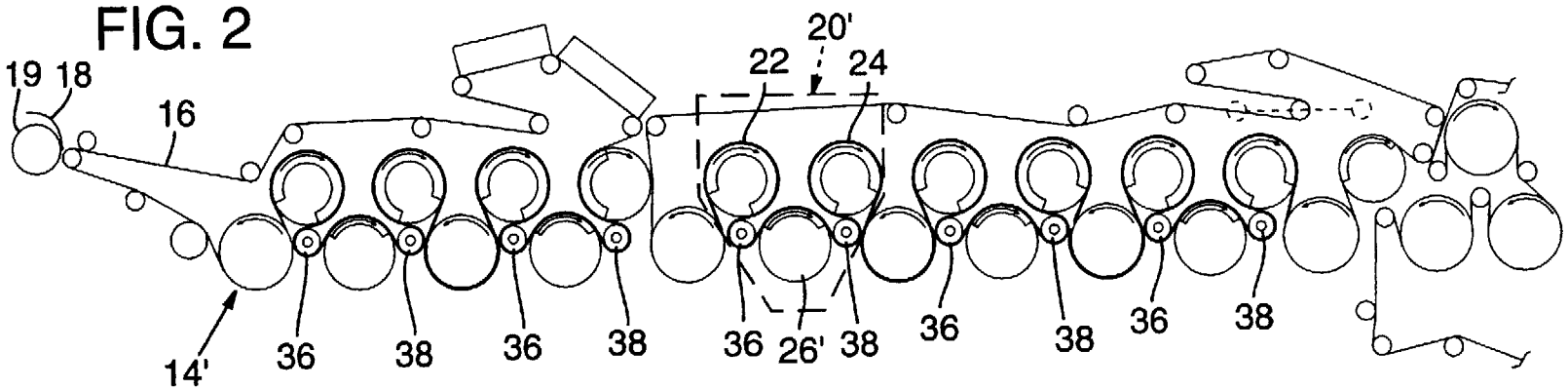
FIG. 2 is a schematic side elevational view of a two-tier, single-felted dryer section in accordance with the present invention.

FIG. 2 illustrates the two-tier dryer section 10 of FIG. 1 modified in accordance with the present invention to include reversing rolls 36, 38. Preferably, a pair of reversing rolls 36, 38 is positioned around every other dryer drum in the lower tier 14' of dryer drums, as illustrated in FIG. 2. It should be understood, however, that fewer pairs of reversing rolls could be used or more pairs, if smaller reversing rolls were used.

As shown in FIG. 2, the pattern of drums and rolls is repeated, and therefore only one group of drums is described herein with the understanding that the other groups of drums in the section are the same.

Figure 4:
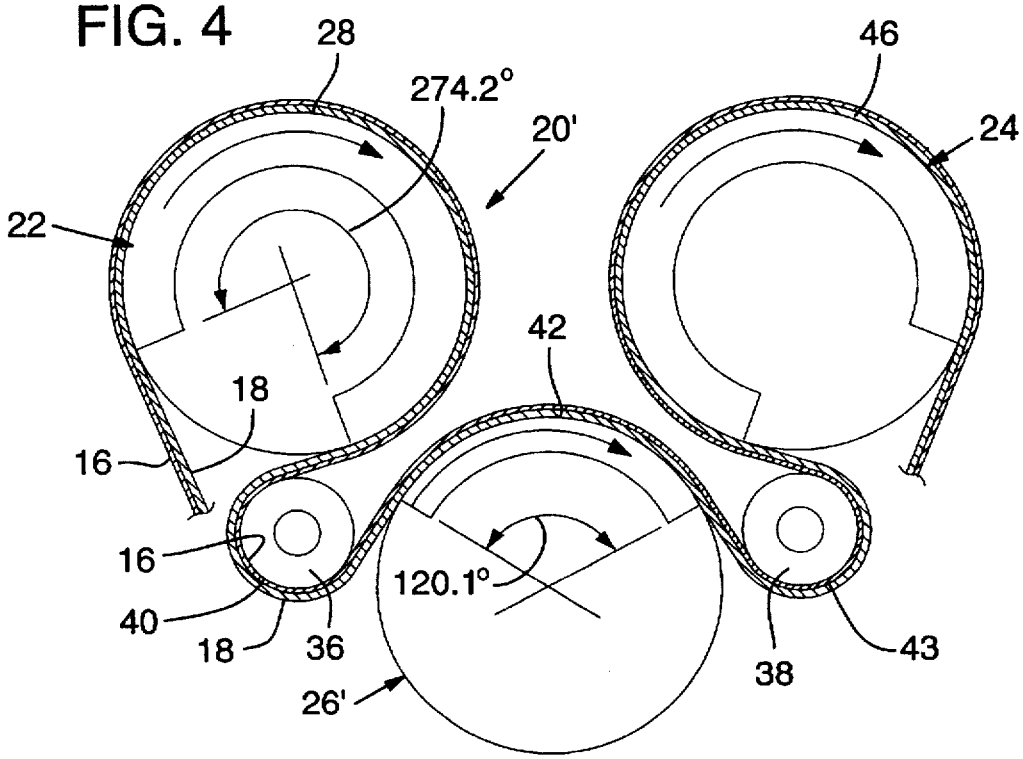
FIG. 4 is an enlarged, schematic side elevational view of a group of three dryer drums and two reversing rolls from FIG. 2, showing the passage of the web and felt through the dryer drums and reversing rolls.

FIG. 4 illustrates a dryer drum group 20', consisting of two adjacent upper tier drums 22, 24, one lower tier drum 26', and two reversing rolls 36, 38. As shown, a first reversing roll 36 is positioned to the left of the lower tier drum 26' below the first upper tier drum 22, and a second reversing roll 38 is positioned to the right of the lower tier drum 26' below the second upper tier drum 24. Preferably, the reversing rolls 36, 38 are placed so that there is approximately one inch between the closest points on each reversing roll 36, 38 and the adjacent upper tier drum 22, 24 and between each reversing roll 36, 38, and the lower tier drum, which minimizes the distance the felt and web are unsupported by a drum surface.

The reversing rolls 36, 38 are smaller than the upper and lower tier dryer drums 12 and 14 to fit within the spaces between adjacent lower tier drums 14. The reversing rolls 36, 38 preferably are constructed of steel, as are typical dryer drums, and may be provided with circumferential grooves to increase web stability on the drums 14. The reversing rolls 36, 38 preferably also have holes so that applying a vacuum to the interior of the rolls 36, 38 helps keep the felt 16 and web 18 against the rolls 36, 38.

As shown in FIG. 4, as the web 18 enters the dryer drum group 20', the web 18 is in direct contact with the upper surface 28 of the first upper tier drum 22. The felt 16 and web 18 then wrap around the lower surface 40 of the first reversing roll 36 of the dryer drum group 20', and the felt 16 is in direct contact with the reversing roll 36. The felt 16 and web 18 proceed to wrap around the top surface 42 of the lower tier drum 26'. During the wrap around the lower tier drum 26', the paper web 18 is in direct contact with the upper surface 42 of the drum 26', in contrast to the prior art wrap around the lower tier drum 26', in which the felt 16 was in direct contact with the lower surface 30 of the drum 26.

The felt 16 and web 18 then wrap around the lower surface 43 of the second reversing roll 38 with the felt 16 in direct contact with the roll 38, and then the felt 16 and web 18 wrap around the upper surface 46 of the second upper tier drum 24 in the dryer drum group 20'. Once again, the paper web 18 is in direct contact with the upper tier drum 24.

In essence, the first reversing roll 36 reverses the position of the web 18 and the felt 16 so that the web 18 is in direct contact with the lower tier drum 26', and the second reversing roll 38 again reverses the position of the web 18 and felt 16 so that the web 18 directly contacts the second upper tier drum 24.

The addition of reversing rolls increases the angular amount over which heat is transferred from the lower tier drum 26', around which reversing rolls 36, 38 are placed, to the web 18 (the "lower wrap") to 120.1°, for the illustrated 30-inch diameter drum. This is a significant increase over the lower wrap in the prior art dryer drum group 20, in which essentially no heat was transferred between the lower tier drum 26 and the felt 16 because of the insulating effect of the felt being sandwiched between the paper web 18 and the lower tier drum 26.

Also, the addition of reversing rolls 36, 38 increases the angular amount that the paper web 18 contacts the upper tier dryer drum 22 (the "upper wrap") to 274.2° for the illustrated 30-inch diameter drums, from 225.4° in the prior art dryer section 10. Thus, the total angular amount over which heat is transferred from the dryer drums 22, 24, and 26' to the paper web 18 is 668.5° (274.2°+274.2°+120.1°), which is almost a 50% increase over the prior art. Corresponding angular changes would occur for drums of different diameters.

It is thus clear that the addition of reversing rolls to the prior art dryer section increases the effective area over which the web is in direct contact with both the upper and lower tiers of dryer drums 12 and 14. With a larger contact area, more heat is transferred from the drums to the paper web 18. As a result, drying efficiency is improved, and therefore paper productivity is also increased.

In addition, with improved heat transfer, the web is stronger and more resistant to web breaks because the web dries to "higher solids." Reduced web breaks improve paper-making machine efficiency and thereby productivity.

Another advantage is that increased heat transfer to the web 18 dries the web 18 faster and thus allows the web to be run through the paper machine at a higher speed, improving paper productivity.

It should be evident from the foregoing that in the prior art dryer section, all the lower tier dryer drums 14 rotate counterclockwise and that in the present dryer section, the lower tier dryer drums around which reversing rolls 36 are placed rotate in a clockwise direction. To accommodate the necessary clockwise rotation of the lower tier dryer drums around which the reversing rolls 36 are placed, the drivers (not shown) for those lower tier dryer drums are removed to allow the felt 16 and web 18 to drive those lower tier dryer drums. Alternatively, gears could be added to drive the lower tier dryer drums in a clockwise direction.

Figure 5:
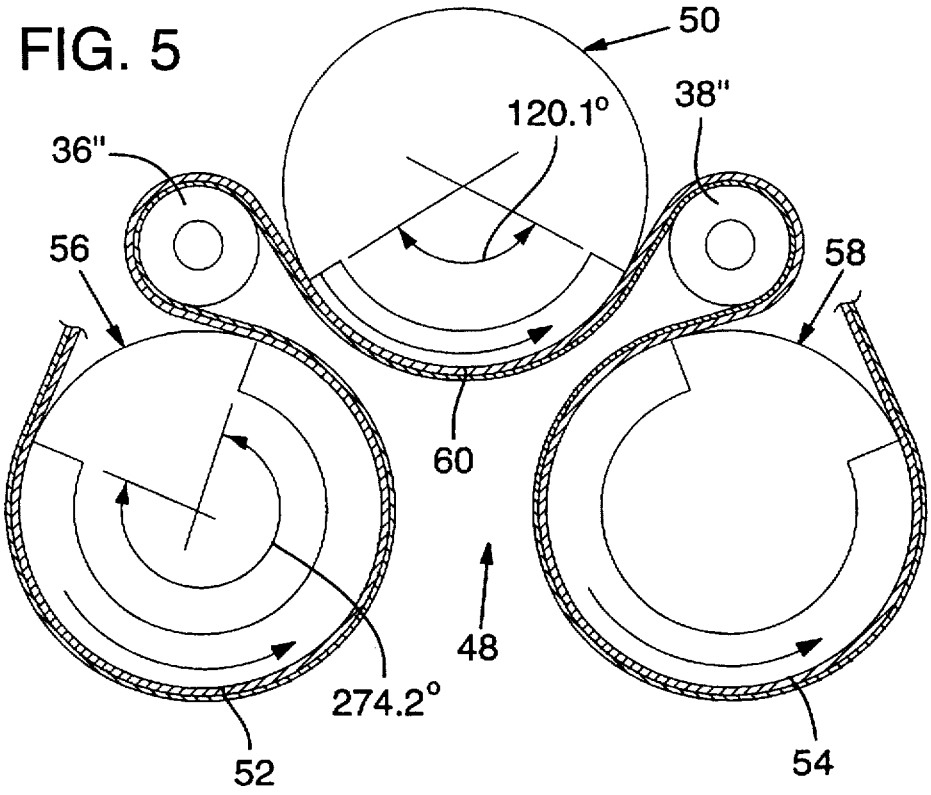
FIG. 5 is an enlarged, schematic side elevational view of an alternative dryer drum group, located downstream of the section of FIG. 1.

Although a prior art dryer section having the web in direct contact with the upper tier drums and the felt in direct contact with the lower tier drums is described, this invention could be used in a prior art dryer section having an alternative dryer drum group 48, which has the web in direct contact with the lower tier drums and the felt in direct contact with the upper tier drums, as shown in FIG. 5. In such a case, the reversing rolls 36", 38" would be placed around every other upper tier dryer drum 50, and the web would be in direct contact with the lower surfaces 52, 54 of the lower tier drums 56, 58 in the dryer drum group 48 and would be in direct contact with the lower surface 60 of the upper tier drum 50 in the dryer drum group 48. The alternative dryer drum group 48 could be located downstream of the dryer drum group 20 of FIG. 4.

This description sets forth various embodiments of the present invention for purposes of illustration only. The description should not be construed to limit the scope of the invention in any way. Numerous other modifications and variations can be made to the invention without departing from the invention as defined by the appended claims and their equivalents.

The invention claimed is:

1. In a two tier dryer section for a paper machine in which a web of paper is supported on a single felt to follow a serpentine path through the section, and in which the section includes an upper tier of spaced apart dryer drums and a lower tier of spaced apart dryer drums, and with the drums of the lower tier being offset from the drums of the upper tier in the spaces therebetween, the upper tier drums having upper surfaces and the lower tier drums having lower surfaces;

a pair of reversing rolls being positioned one on each of the opposite sides of a lower tier drum in a space between the lower tier drum and an adjacent lower tier drum and below an upper tier drum, such that the lower tier drum and two adjacent upper tier drums above the pair of reversing rolls comprise a dryer drum group, the pair of reversing rolls being positioned completely within an envelope defined by an imaginary line drawn through the uppermost points on the upper surfaces of the upper tier drums and an imaginary line drawn through the lowermost points on the lower surfaces of the lower tier drums;

the web and felt extending together in a path that includes, in sequence, a wrap around the upper surface of one of the two adjacent upper tier drums of the group, thence a wrap around a lower surface of one of the pair of reversing rolls below the one upper tier drum, thence a wrap around an upper surface of the lower tier drum of the group, thence a wrap around a lower surface of the other reversing roll of the pair, and thence a wrap around the upper surface of the other of the two adjacent upper tier drums, such that the web is in direct face-to-face contact with the upper surfaces of both upper tier drums and the lower tier drum of the group.

2. The dryer section of claim 1 in which all three drums of the group rotate in the same direction.

3. The dryer section of claim 1 in which the wrap around the upper tier dryer drums of the group is at least about 250°.

4. The dryer section of claim 1 in which the wrap around the lower tier drum of the group is at least about 100°.

5. The dryer section of claim 1 in which the wrap around the upper tier dryer drums of the group is at least about 250° and the wrap around the lower tier drum of the group is at least about 100°.

6. The dryer section of claim 1 further comprising a gear for driving the lower tier drum of the group to rotate in the same direction as the upper tier drums of the group.

7. The dryer section of claim 1 in which the lower tier drum of the group is driven by the felt.

8. The dryer section of claim 1 in which the wrap around the upper tier drums of the group is at least about 270°.

9. The dryer section of claim 1 in which the wrap around the lower tier drum of the group is at least about 120°.

10. The dryer section of claim 1 wherein there are multiple said dryer drum groups in the section, each group including a pair of reversing rolls positioned one on each of the opposite sides of the lower tier drum of the group, and wherein the web and felt move together along the same path through each group.

11. The dryer section of claim 10 in which the said adjacent lower tier drum is an auxiliary drum that separates adjacent dryer drum groups in the section.

12. The dryer section of claim 10 wherein adjacent lower tier drums in the section rotate in opposite directions whereas adjacent upper tier drums in the section rotate in the same direction.

13. The dryer section of claim 11 wherein at least one lower tier drum in the section is unheated.

14. The dryer section of claim 10 wherein at least some of the lower tier drums are rotatably driven by the felt.

15. In a two-tier dryer section for a paper machine in which a web of paper is supported on a single felt to follow a serpentine path through the section, and in which the section includes an upper tier of spaced apart dryer drums and a lower tier of spaced apart dryer drums, and with the drums of the lower tier being offset from the drums of the upper tier in the stances therebetween, the upper tier drums having upper surfaces and the lower tier drums having lower surfaces;

a pair of reversing rolls being positioned one on each of the opposite sides of an upper tier drum in a space between the upper tier drum and an adjacent upper tier drum and above a lower tier drum, such that the upper tier drum and two adjacent lower tier drums below the pair of reversing rolls comprise a dryer drum group, the pair of reversing rolls being positioned completely within an envelope defined by an imaginary line drawn through the uppermost points on the upper surfaces of the upper tier drums and an imaginary line drawn through the lowermost points on the lower surfaces of the lower tier drums;

the web and felt extending together in a path that includes, in sequence, a wrap around the lower surface of one of the two adjacent lower tier drums of the group, thence a wrap around an upper surface of one of the pair of reversing rolls above the one lower tier drum, thence a wrap around a lower surface of the upper tier drum of the group, thence a wrap around an upper surface of the other reversing roll of the pair, and thence a wrap around the lower surface of the other of the two adjacent lower tier drums, such that the web is in direct face-to-face contact with the lower surfaces of both lower tier drums and the upper tier drum of the group.

16. The dryer section of claim 15 in a two-tier dryer section in which all three drums of the group rotate in the same direction.

17. The dryer section of claim 15 in a two-tier dryer section in which the wrap around the lower tier dryer drums of the group is at least about 250°.

18. The dryer section of claim 15 in a two-tier dryer section in which the wrap around the upper tier drum of the group is at least about 100°.

19. The dryer section of claim 15 in a two-tier dryer section in which the wrap around the lower tier dryer drums of the group is at least about 250° and the wrap around the upper tier drum of the group is at least about 100°.

20. The dryer section of claim 15 further comprising a gear for driving the upper tier drum of the group.

21. The dryer section of claim 15 in a two-tier dryer section in which the upper tier drum of the group is driven by the felt.

22. The dryer section of claim 15 in a two-tier dryer section in which the wrap around the lower tier drums of the group is at least about 270°.

23. The dryer section of claim 15 in a two-tier dryer drum section in which the wrap around the upper tier drum of the group is at least about 120°.

24. The dryer section of claim 15 wherein there are multiple said dryer drum groups in the section, each group including a pair of reversing rolls positioned one on each of the opposite sides of the upper tier drum of the group, and wherein the web and felt move together along the same path through each group.

25. The dryer section of claim 24 in which the said adjacent lower tier drum is an auxiliary drum that separates adjacent dryer drum groups in the section.

26. The dryer section of claim 24 wherein adjacent upper tier drums in the section rotate in opposite directions whereas adjacent lower tier drums in the section rotate in the same direction.

27. The dryer section of claim 25 wherein at least one upper tier drum in the section is unheated.

28. The dryer section of claim 24 wherein at least some of the upper tier drums are rotatably driven by the felt.

29. A method for increasing the drying efficiency of a two-tier, single-felted dryer section of a paper machine in which each tier of the dryer includes multiple spaced-apart dryer drums and in which a web, supported by a felt, normally travels in a serpentine path alternately about the upper surfaces of the upper tier dryer drums and the lower surfaces of the lower tier dryer drums and in which normally the web directly contacts the surfaces of the dryer drums of one tier and the felt directly contacts the surfaces of the dryer drums of the other tier, and in which the dryer drums in the two tiers include at least one group of three dryer drums, the one group including adjacent first and second dryer drums in one tier and a third dryer drum in the other tier, the third dryer drum being offset between the spaced-apart first and second dryer drums, the first, second, and third dryer drums each having an outboard surface with an outermost point, the method comprising the steps of:

positioning a pair of first and second reversing rolls in the dryer drum group, the first reversing roll being positioned on one side of the third dryer drum and between the outermost points on the outboard surfaces of the first and third dryer drums, the second reversing roll being positioned on the other side of the third dryer drum and between the outermost points on the outboard surfaces of the second and third dryer drums; and feeding the web and felt together in a path through the dryer drum group so that in sequence the web directly contacts and wraps a surface of the first dryer drum, then wraps a surface of the first reversing roll, then directly contacts and wraps a surface of the third dryer drum, then wraps a surface of the second reversing roll, and then directly contacts and wraps a surface of the second dryer drum, such that the web is in direct contact with all three drums of the dryer drum group.

30. The method of claim 29 in which the felt drives the third dryer drum.

31. The method of claim 29 in which a gear drives the third dryer drum.

32. The method of claim 29 in which the reversing rolls are foraminous and further including the step of applying a vacuum to the reversing rolls to stabilize the web and felt on the reversing rolls.

33. The method of claim 29 in which the dryer section includes multiple dryer drum groups; positioning a pair of first and second said reversing rolls on opposite sides of the third dryer dram and aligned with the first and second dryer drums in each group, and feeding the web and felt together in said path through each dryer dram group, such that the web is in direct contact with all three dryer drums in all of said dryer drum groups.

34. The method of claim 29 wherein the third drum of the group is in the upper tier.

35. The method of claim 29 wherein the third drum of the group is in the lower tier.

36. The method of claim 29 wherein there are two said dryer sections and wherein the third drum in at least a first said group of a first section is in the upper tier and the third drum of at least a second said group of the second section is in the lower tier such that one face of the web comes into direct contact with all three drums of the first said group and the other face of the web comes into direct contact with all three drums of the second said group as the web passes through the dryer sections.

37. The method of claim 29 including positioning the two reversing rolls of said pair on opposite sides of an upper tier dryer drum.

38. The method of claim 29 including positioning the two reversing rolls of said pair on opposite sides of a lower tier dryer drum.

39. The method of claim 29 wherein there are multiple said dryer drum sections and including positioning the two reversing rolls of one said pair on opposite sides of an upper tier dryer drum in a first section such that said upper tier drum becomes said third drum of a first group, and positioning the two reversing rolls of another said pair on opposite sides of a lower tier dryer drum in a second section such that said lower tier drum becomes the third drum of a second group, whereby one face of the web is in direct contact with the dryer drum surfaces of the three drums in the first group and the opposite face of the web is in direct contact with the dryer drum surfaces of the three drums in the second group as the web passes through the dryer sections.

40. A two-tier dryer section for a paper machine, the dryer section comprising:

a first tier of spaced apart dryer drums;

a second tier of spaced apart dryer drums, substantially parallel to the first tier of dryer drums and with the drums of the second tier being offset from the drums of the first tier in the spaces therebetween, each of the first and second tier drums having a center, the first and second tiers of dryer drums including at least one dryer drum group of three drums, the group having adjacent first and second drums in the first tier and a third drum in the second tier, the third drum being located between the first and second drums;

first and second reversing rolls, the first reversing roll being positioned on one side of the third drum and being generally aligned with the first drum and the second reversing roll being positioned on the other side of the third drum and being generally aligned with the second drum, the first and second reversing rolls being positioned substantially between a first imaginary line drawn through the centers of the drums in the first tier and a second imaginary line drawn through the centers of the drums in the second tier;

a web of paper; and a single felt supporting the web, the felt and web following a generally serpentine path through the first and second tier of dryer drums, the path including a passage through the dryer drum group, the passage including, in sequence, a wrap around the first drum, a wrap around the first reversing roll, a wrap around the third drum, a wrap around the second reversing roll, and then a wrap around the second dryer drum, the felt and web being oriented so that the web directly contacts the first, second, and third dryer drums and the felt directly contacts the first and second reversing rolls.

41. The dryer section of claim 40 in which the wrap around each of the first and second drums is at least about 250°.

42. The dryer section of claim 40 in which the wrap around the third drum is at least about 100°.

43. The dryer section of claim 40 in which the third drum is in the upper tier.

44. The dryer section of claim 40 in which the third drum is in the lower tier.

45. The dryer section of claim 40 including a first dryer section and a second dryer section, each section including a dryer drum group, the dryer drum group of the first section including a third drum in one tier, the dryer drum group of the second section including a third drum in a tier opposite said one tier, and in which one face of the web passing through the group in one section makes direct contact with all three drums of the group, and the opposite face of the web passing through the group in the other section makes direct contact with all three drums of the groups in the other section.

46. The dryer section of claim 1 in which the lower tier dryer drum and the upper tier dryer drums of the group have the same diameters.

47. The dryer section of claim 1 in which the lower tier dryer drum of the group has a diameter and the web and felt are supported against at least one of the upper tier and lower tier dryer drums throughout at least a portion of the group and are unsupported for a length less than the diameter of the lower tier dryer drum of the group.

48. The dryer section of claim 1 in which the upper tier dryer drums and the lower tier dryer drum of the group each have an axis, the reversing rolls each have an axis, and the axes of the reversing rolls are between the axes of the upper tier dryer drums and the lower tier dryer drum in the group.

49. The dryer section of claim 15 in which the first, second, and third dryer drums are heated.

* * * * *